US012467449B2

(12) United States Patent
Ryu

(10) Patent No.: US 12,467,449 B2
(45) Date of Patent: Nov. 11, 2025

(54) TRANSFER PUMP FOR A FIXED AMOUNT OF FLUID

(71) Applicant: TECHCROSS INC., Seoul (KR)

(72) Inventor: Chae Hyung Ryu, Busan (KR)

(73) Assignee: TECHCROSS INC., Seoul (KR)

( * ) Notice: Subject to any disclaimer, the term of this patent is extended or adjusted under 35 U.S.C. 154(b) by 145 days.

(21) Appl. No.: 18/290,152

(22) PCT Filed: Feb. 7, 2022

(86) PCT No.: PCT/KR2022/001823
§ 371 (c)(1),
(2) Date: Oct. 5, 2024

(87) PCT Pub. No.: WO2023/286965
PCT Pub. Date: Jan. 19, 2023

(65) Prior Publication Data

US 2025/0341207 A1 Nov. 6, 2025

(30) Foreign Application Priority Data

Jul. 14, 2021 (KR) ..... 10-2021-0092239

(51) Int. Cl.
*F04B 43/12* (2006.01)
*F04B 13/00* (2006.01)

(52) U.S. Cl.
CPC ..... *F04B 43/1223* (2013.01); *F04B 13/00* (2013.01)

(58) Field of Classification Search
CPC ..... F04B 43/1223; F04B 13/00
See application file for complete search history.

(56) References Cited

U.S. PATENT DOCUMENTS

2006/0222539 A1* 10/2006 Hetherington ..... G09B 9/02 417/477.1
2020/0149525 A1* 5/2020 Cheung ..... A61M 5/14228

FOREIGN PATENT DOCUMENTS

JP 06-017013 Y2 * 1/1989
JP 06017013 Y 5/1994
JP 07139470 A 5/1995
JP 2016160901 A 9/2016
(Continued)

OTHER PUBLICATIONS

English Translation JP 06-017013 Y2 (Year: 1989).*
International Search Report—PCT/KR2022/001823 dated Oct. 19, 2022.

*Primary Examiner* — Shafiq Mian
(74) *Attorney, Agent, or Firm* — CANTOR COLBURN LLP

(57) ABSTRACT

Provided is a transfer pump for a fixed amount of fluid, the transfer pump including: a tube guide block that is inserted to partially expose a fluid transfer tube; a tube compression block that is reciprocally disposed on the tube guide block and compresses the exposed portion of the tube inserted into the tube guide block to transfer the fluid; an air cylinder that has a rod connected to the tube compression block and reciprocates the tube compression block by reciprocating the rod in a linear direction by using compressed air; and an elastic member that allows the tube compression block to compress the tube by applying an elastic force to the air cylinder, such that the tube can be accurately compressed and a fixed amount of fluid can be discharged.

10 Claims, 5 Drawing Sheets

(56) References Cited

FOREIGN PATENT DOCUMENTS

| | | | |
|---|---|---|---|
| KR | 100832042 | B1 | 5/2008 |
| KR | 102100225 | B1 | 5/2020 |
| KR | 102259410 | B1 | 6/2021 |

* cited by examiner

TRANSFER PUMP FOR A FIXED AMOUNT OF FLUID

TECHNICAL FIELD OF INVENTION

The present invention relates to a transfer pump for a fixed amount of fluid that transfers fluid by compressing a tube using air as a power source.

BACKGROUND INFORMATION AND PRIOR ART

In general, a fluid transfer pump is a device that transfers fluid such as liquid or gas using pressure. This fluid transfer pump is widely used as a means of transferring fluids, including environmental pollution prevention facilities such as sewage treatment facilities, oil well facilities such as crude oil and natural gas, fluid transfer facilities for the chemical industry, and pumping facilities.

Here, the fluid transfer pump used to transfer a small amount of chemicals such as reagents or neutralizers is configured to discharge a fixed amount of fluid using an electric motor or solenoid valve. However, conventional electrically operated fluid transfer pumps are inherently restricted for use in explosion-proof devices.

For this reason, a fluid transfer pump has recently been developed that transfers fluid by compressing a tube using the reciprocating motion of an air cylinder. However, in the case of a conventional fluid transfer pump using air, the tube is not compressed accurately due to the shape of the tube, processing/assembly errors of parts for compressing the tube, and deviation of the rod that appears during the reciprocating motion of the air cylinder, thus the amount of fluid transferred (discharged) changes. Therefore, the conventional fluid transfer pump has a problem in that its function as a metering pump was poor.

Prior art document 1: Korean patent No. 10-0832042

Prior art document 2: Korean patent No. 10-2259410

SUMMARY OF THE INVENTION

It is an object of the present invention to provide a transfer pump for a fixed amount of fluid that can be safely used even in explosion-proof areas by being driven using compressed air.

Another object of the present invention is to provide a transfer pump for a fixed amount of fluid capable of accurately compressing a tube and discharging a fixed amount of fluid.

Technical Solution

The transfer pump for a fixed amount of fluid according to the present invention comprises a tube guide block into which a fluid transfer tube is inserted so that the fluid transfer tube is partially exposed; a tube compression block arranged to be capable of reciprocating movement on the tube guide block and compressing an exposed portion of the tube inserted into the tube guide block to transfer fluid; an air cylinder which has a rod connected to the tube compression block and reciprocates the tube compression block by reciprocating the rod in a linear direction using compressed air; and an elastic member which applies elastic force to the air cylinder and causes the tube compression block to compress the tube.

Preferably, the tube guide block comprises a guide rail which guides the reciprocating movement of the tube compression block; and a tube insertion path formed inside of the guide rail, having a '∩'-shaped cross section when viewed from the side, and having a linear path with a portion of the tube exposed to the outside along the upper surface of the guide rail, wherein the tube inserted into the tube insertion path is exposed to the outside along the upper surface of the guide rail and compressed by the tube compression block.

Preferably, the tube compression block comprises a pair of side plates arranged side by side and spaced apart from each other; a connecting bar placed between the pair of side plates to connect the pair of side plates, and coupled to the rod; and a roller member which is rotatably installed between the pair of side plates and compresses the tube while sliding or rolling along the guide rail.

Preferably, the roller member comprises a first roller member provided in front of the side plate and a second roller member provided at the rear of the side plate, wherein the distance between the first roller member and the second roller member corresponds to the length of the tube exposed to the outside along the upper surface of the guide rail, and wherein the first roller member enables the transfer of the fluid in the tube when the tube compression block moves forward, while the second roller member blocks fluid transfer within the tube when the tube compression block moves backward.

Preferably, the guide rail comprises a plurality of guide rails spaced apart from each other perpendicular to the direction in which the tube compression block moves, wherein the tube insertion path is formed in each guide rail, and wherein the roller member includes a number of rollers corresponding to the number of guide rails, enabling fluid transfer in a plurality of tubes.

Preferably, the elastic member is any one of a compression spring, a tension spring, a torsion spring, and a leaf spring, wherein the elastic member is installed between the tube guide block or a frame formed integrally with the tube guide block and the air cylinder to press the air cylinder upward, thereby exerting downward force on the tube compression block connected to the rod of the air cylinder.

More preferably, the air cylinder is designed to rotate clockwise or anti-clockwise via the elastic member.

In addition, the tube compression block is connected to the rod of the air cylinder so as to rotate around the connecting bar.

Preferably, the tube compression block is connected to the rod of the air cylinder so as to be tiltable left and right along the width direction of the tube guide block.

Advantageous Effects

The transfer pump for a fixed amount of fluid according to the present invention is operated using compressed air rather than electricity. Therefore, this design ensures the safe use of the transfer pump in explosion-proof products or explosion-proof areas.

According to the present invention, the tube compression block can compress the tube with a constant force due to the elastic force of the elastic member, thereby enabling the discharge of a fixed amount of fluid.

According to the present invention, due to the rotation of anti-clockwise upwards and clockwise downwards of the air cylinder and the rotation of the tube compression block, the tube can be compressed stably and accurately even when the diameter or shape of the fluid transfer tube changes, enabling the discharge of a fixed amount of fluid.

DETAILED DESCRIPTION OF THE EXEMPLARY EMBODIMENTS

Figure 1:
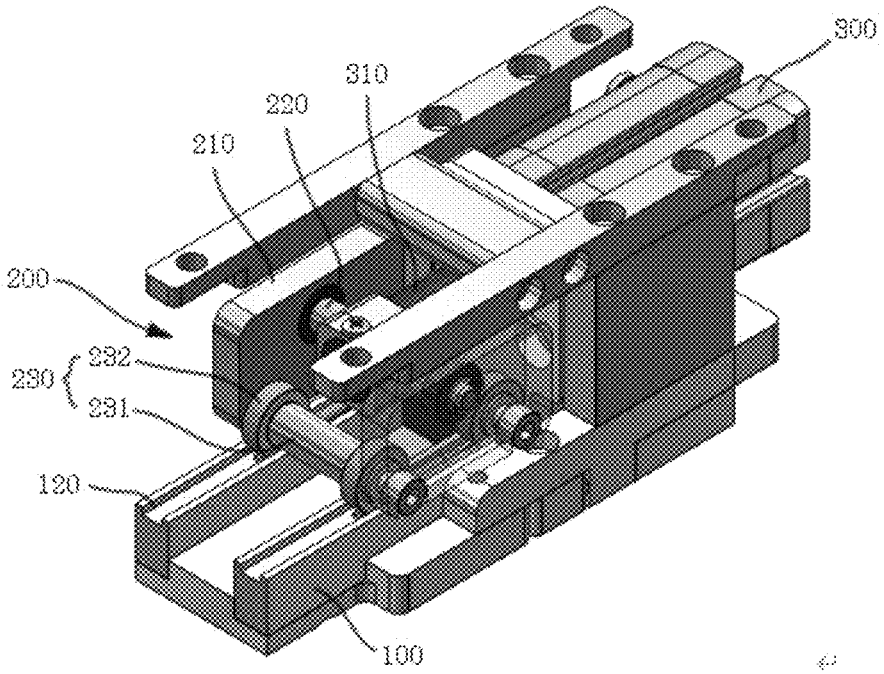
FIG. 1 is a perspective view illustrating a transfer pump for a fixed amount of fluid according to the present invention.
Figure 2:
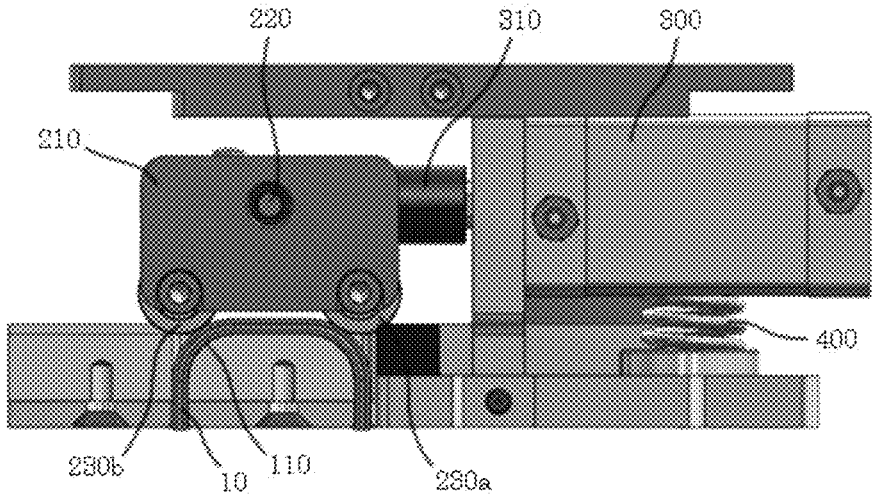
FIG. 2 is a side view illustrating the transfer pump for a fixed amount of fluid according to the present invention, cut away to expose the inside of the tube guide block.
Figure 3:
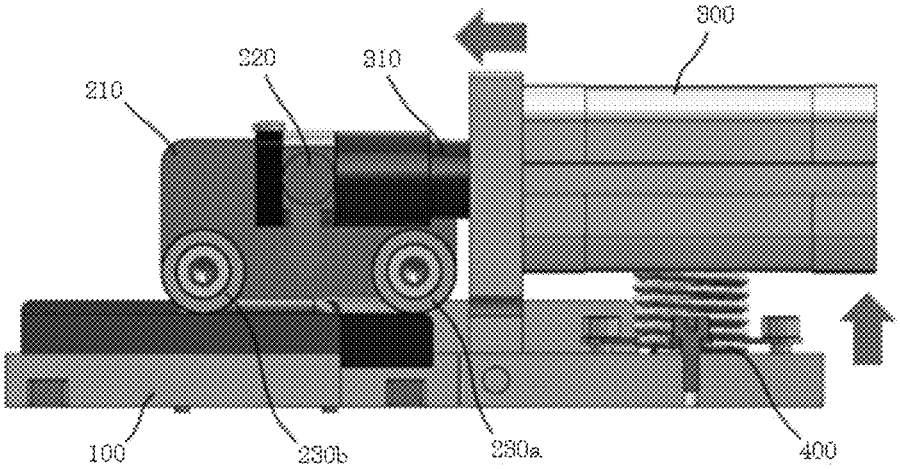
FIG. 3 is a side view illustrating the transfer pump for a fixed amount of fluid according to the present invention, cut away to expose the inside of a tube compression block.

Referring to FIGS. 1 to 3, a transfer pump for a fixed amount of fluid according to the present invention comprises a tube guide block 100 which allows a fluid transfer tube 10 to be inserted along a predetermined path, a tube compression block 200 which compresses the tube 10 inserted into the tube guide block 100 to transfer fluid, an air cylinder 300 responsible for moving the tube compression block 200, and elastic member 400 which applies elastic force to the air cylinder 300.

The tube guide block 100 has a tube insertion path 110 designed to expose a portion of the fluid transfer tube 10 to the outside. The tube 10 is inserted into the tube insertion path 110, where a portion of the tube 10 is exposed to the outside and compressed by the tube compression block 200.

The tube compression block 200 is arranged to be capable of reciprocating movement, that is of performing a back-and-forth movement on the tube guide block 100. In addition, the tube compression block 200 moves back and forth to compresses the exposed portion of the tube 10 that has been inserted into the tube guide block 100, thereby allowing the transfer of fluid within the tube 10.

The air cylinder 300 is provided with a rod 310 connected to the tube compression block 200, and operates by reciprocating the rod 310 in a linear direction using compressed air, thereby causing the tube compression block 200 to be reciprocate. That is, the air cylinder 300 allows the rod 310 to perform piston movement using compressed air.

The elastic member 400 applies elastic force to the air cylinder 300, which, in turn, presses the tube compression block 200 connected to the rod 310 of the air cylinder 300 downward, allowing the tube compression block 200 to compress the tube 10.

Due to the configuration of the present invention, when the air cylinder 300 operates and the rod 310 reciprocates in a linear direction, if the tube compression block 200 moves forward, the fluid within the tube 10 is transferred, and if the tube compression block 200 moves backwards, fluid transfer within the tube 10 is blocked. As a result, a fixed amount of fluid in the tube 10 can be discharged in accordance with the back-and-forth movement of the tube compression block 200.

Furthermore, the transfer pump for a fixed amount of fluid according to the present invention is operated using compressed air rather than electricity. Therefore, this design ensures the safe use of the transfer pump in explosion-proof products or explosion-proof areas.

Preferably, the tube guide block 100 comprises a guide rail 120 and a tube insertion path 110. The guide rail 120 extends parallel to the direction of movement of the rod 310 of the air cylinder 300 on the upper surface of the tube guide block 100, and guides the reciprocating movement, which includes forward and backward movement, of the tube compression block 200. In addition, the tube insertion path 110 is formed inside the guide rail 120, has an approximately '∩' shaped cross-section when viewed from the side, and has a linear path with a portion of the tube exposed to the outside along the upper surface of the guide rail 120.

The tube guide block 100 is configured to expose a portion of the tube 10 inserted into the tube insertion path 110 to the outside in a linear direction along the upper surface of the guide rail 120 and this exposed portion of the tube 10 can be compressed by the tube compression block 200. Here, the tube compression block 200 compresses only the portion of the tube 10 exposed to the outside along the guide rail 120 during reciprocating movement, ensuring transfer of a fixed amount of fluid.

Meanwhile, the tube compression block 200 comprises a pair of side plates 210, a connecting bar 220 which connects the pair of side plates 210, and a roller member 230 which directly compresses the tube 10.

The pair of side plates 210 are arranged side by side and spaced apart from each other at an interval approximately corresponding to the width of the tube guide block 100. The connecting bar 220 extends between the pair of side plates 210 in a direction perpendicular to the longitudinal axis of the rod 310, thereby connecting the pair of side plates 210. This connecting bar 220 is located above the center of the side plate 210, is coupled to the rod 310 of the air cylinder 300, and enables the movement of the tube compression block 200, which includes the side plates 210, when the rod 310 moves. The roller member 230 includes a rotation shaft 231 connected between the pair of side plates 210 and a roller 232 attached to the rotation shaft 231. The rotation shaft 231 is rotatably installed on the lower side of the side plate 210. The roller 232 is formed integrally with the rotation shaft 231 and is used to compress the tube 10 while sliding or rolling along the guide rail 120 when the tube compression block 200 moves.

Here, the roller member 230 may include a first roller member 230*a* provided on the rear side of the side plate 210 and a second roller member 230*b* provided on the front side of the side plate 210. The distance between the first roller member 230*a* and the second roller member 230*b* is designed to correspond to the length of the tube 10 exposed to the outside along the upper surface of the guide rail 120.

Figure 4A:
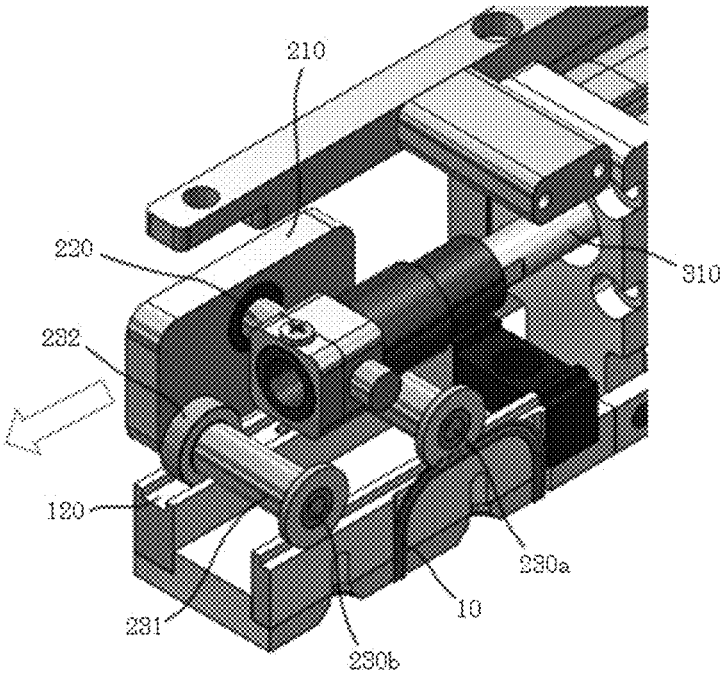
FIGS. 4*a* and 4*b* are perspective views illustrating a state in which the tube compression block of the transfer pump for a fixed amount of fluid according to the present invention is moving forward and backward.

Before the operation of the transfer pump for fixed amount of fluid according to the present invention, the exposed portion of the tube 10 is located between the first roller member 230*a* and the second roller member 230*b* (see FIG. 2). When the air cylinder 300 operates and the rod 310 moves forward, that is, when the tube compression block 200 moves forward, the tube 10 is compressed by the first roller member 230*a*, thereby transferring the fluid (see FIG. 4*a*). Conversely, when the rod 310 moves backwards, that is, when the tube compression block 200 moves backwards, the tube 10 is compressed by the second roller member 230*b*, thereby blocking fluid transfer (see FIG. 4*b*).

Additionally, the guide rail 120 may be comprised of a plurality of guide rails depending on product specifications. In this configuration, the guide rails 120 are arranged to be spaced apart from each other along a direction perpendicular to the moving direction of the tube compression block 200, the tube insertion path 110 is formed on each guide rail, and the roller member 230 also has a number of rollers 232 corresponding to the number of guide rails, enabling fluid transfer in multiple tubes. While this specification describes two guide rails 120 and two rollers 232, the number of guide rails and rollers may be three or more, depending on product design specifications.

Preferably, the elastic member 400 may be a compression spring, tension spring, torsion spring, or leaf spring. The elastic member 400 may be any type of spring as long as it can exert upward force on the air cylinder 300.

Here, the elastic member 400 is installed between the tube guide block 100 (or a frame formed integrally with the tube guide block 100) and the air cylinder 300 to rotate the air cylinder 300 anti-clockwise upwards. Then, the tube compression block 200 connected to the rod 310 of the air cylinder 300 is rotated anti-clockwise downwards. That is, the elastic member 400 presses the air cylinder 300 upwards, and thereby pressing the tube compression block 200 downwards (see FIG. 3).

Figure 5A:
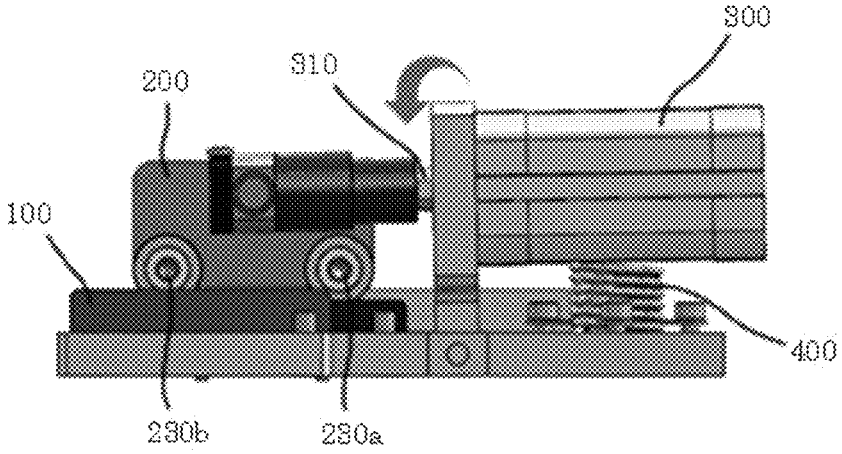
FIGS. 5*a*, 5*b*, and 5*c* are diagrams illustrating the rotational state of an air cylinder, a rod, and the tube compression block of the transfer pump for a fixed amount of fluid according to the present invention.

In order to stably pressurize the tube compression block 200, the air cylinder 300 is configured to rotate clockwise or anti-clockwise via the elastic member 400. Referring to FIG. 5*a*, the air cylinder 300 is not directly connected to the tube guide block 100 except for the elastic member 400. In Addition, the elastic member 400 is disposed on the outside in a direction away from the tube compression block 200 from the longitudinal center of the air cylinder 300. Accordingly, the rear side of the air cylinder 300 is pressed anti-clockwise upwards by the elastic force of the elastic member 400 and the front side of the air cylinder 300 is rotated anti-clockwise downwards, so that the rod 310 and the tube compression block 200 can be pressed downwards.

Due to the configuration of the air cylinder 300 which can be rotated anti-clockwise upwards and clockwise downwards, even when the diameter of the fluid transfer tube is smaller than the appropriate value, the tube compression block 200 can stably and accurately compress the tube, thereby enabling the discharge of a fixed amount of fluid.

Figure 4B:
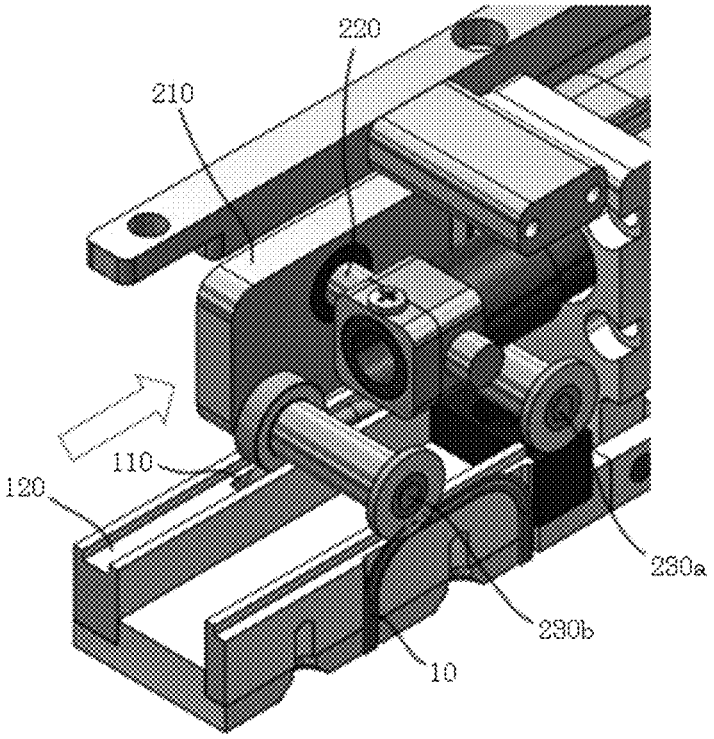
Figure 5B:
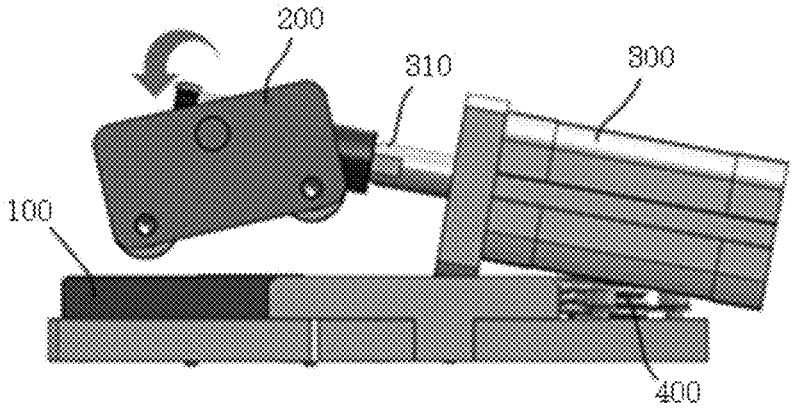
Figure 5C:
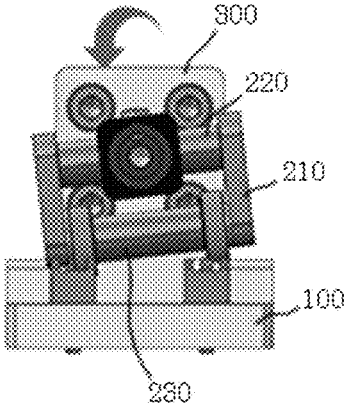

Referring to FIGS. 4*b*, 5*b*, and 5*c*, the tube compression block 200 is rotatably connected to the rod 310 of the air cylinder 300 around the connecting bar 220. Specifically, the connecting rod 220 of the tube compression block 200 and the rod 310 of the air cylinder 300 are rotatably connected with the connecting rod 220 as an axis.

Due to the configuration of the tube compression block 200, which can be rotated, even when the diameter of the fluid transfer tube is larger than the appropriate value or the shape of the fluid transport tube is different, the air cylinder 300 and the tube compression block 200 rotate to stably compress the tube, thereby enabling the discharge of a fixed amount of fluid.

Additionally, as shown in FIG. 5*c*, the tube compression block 200 may be connected to the rod 310 of the air cylinder 300 so as to be tiltable left and right along the width direction of the tube guide block 100.

The tiltable configuration of the tube compression block 200 also enables the tube to be stably compressed, thereby enabling the discharge of a fixed amount of fluid.

The invention claimed is:

1. A transfer pump for a fixed amount of fluid comprising:

a tube guide block into which a fluid transfer tube is inserted so that the fluid transfer tube is partially exposed;

a tube compression block arranged to be capable of reciprocating movement on the tube guide block and compressing an exposed portion of the tube inserted into the tube guide block to transfer fluid;

an air cylinder which has a rod connected to the tube compression block and reciprocates the tube compression block by reciprocating the rod in a linear direction using compressed air; and an elastic member which is externally connected to the air cylinder and applies elastic force to the air cylinder and causes the tube compression block to compress the tube.

2. The transfer pump for a fixed amount of fluid according to claim 1, wherein the tube guide block comprises:

a guide rail which guides the reciprocating movement of the tube compression block; and a tube insertion path formed inside of the guide rail, having a '∩'-shaped cross section when viewed from the side, and having a linear path with a portion of the tube exposed to the outside along the upper surface of the guide rail, wherein the tube inserted into the tube insertion path is exposed to the outside along the upper surface of the guide rail and compressed by the tube compression block.

3. The transfer pump for a fixed amount of fluid according to claim 2, wherein the tube compression block comprises:

a pair of side plates arranged side by side and spaced apart from each other;

a connecting bar placed between the pair of side plates to connect the pair of side plates, and coupled to the rod; and a roller member which is rotatably installed between the pair of side plates and compresses the tube while sliding or rolling along the guide rail.

4. The transfer pump for a fixed amount of fluid according to claim 3, wherein the roller member comprises a first roller member provided in front of the side plate and a second roller member provided at the rear of the side plate, wherein the distance between the first roller member and the second roller member corresponds to the length of the tube exposed to the outside along the upper surface of the guide rail, and wherein the first roller member enables the transfer of the fluid in the tube when the tube compression block moves forward, while the second roller member blocks fluid transfer within the tube when the tube compression block moves backward.

5. The transfer pump for a fixed amount of fluid according to claim 3, wherein the guide rail comprises a plurality of guide rails spaced apart from each other perpendicular to the direction in which the tube compression block moves, wherein the tube insertion path is formed in each guide rail, and wherein the roller member includes a number of rollers corresponding to the number of guide rails, enabling fluid transfer in a plurality of tubes.

6. The transfer pump for a fixed amount of fluid according to claim 1, wherein the elastic member is any one of a compression spring, a tension spring, a torsion spring, and a leaf spring, wherein the elastic member is installed between the tube guide block or a frame formed integrally with the tube guide block and the air cylinder to press the air cylinder upward, thereby exerting downward force on the tube compression block connected to the rod of the air cylinder.

7. The transfer pump for a fixed amount of fluid according to claim 6, wherein the air cylinder is designed to rotate clockwise or anti-clockwise via the elastic member.

8. The transfer pump for a fixed amount of fluid according to claim 7, wherein the tube compression block is connected to the rod of the air cylinder so as to rotate around the connecting bar.

9. The transfer pump for a fixed amount of fluid according to claim 6, wherein the tube compression block is connected to the rod of the air cylinder so as to be tiltable left and right along the width direction of the tube guide block.

10. The transfer pump for a fixed amount of fluid according to claim 7, wherein the tube compression block is connected to the rod of the air cylinder so as to be tiltable left and right along the width direction of the tube guide block.

* * * * *